US005111920A

United States Patent [19]

Castelli et al.

[11] Patent Number: 5,111,920

[45] Date of Patent: May 12, 1992

[54] LUGGAGE CASE WITH RECESSED LATCHES

[75] Inventors: Renato Castelli, Gent; Willibald Van Hoye, Zwijnaarde, both of Belgium; Richard Miles, Crowborough Hill; Stephen T. Green, Clanfield, both of United Kingdom

[73] Assignee: Samsonite Corporation, Denver, Colo.

[21] Appl. No.: 530,502

[22] PCT Filed: Oct. 8, 1986

[86] PCT No.: PCT/GB86/00606

§ 371 Date: Aug. 24, 1987

§ 102(e) Date: Aug. 24, 1987

[87] PCT Pub. No.: WO87/02553

PCT Pub. Date: May 7, 1987

Related U.S. Application Data

[63] Continuation of Ser. No. 319,843, Mar. 7, 1989, abandoned, which is a continuation of Ser. No. 73,795, Aug. 24, 1987, abandoned.

[30] Foreign Application Priority Data

Oct. 31, 1985 [EP] European Pat. Off. ..... 85307923.4

[51] Int. Cl.[5] ..... A45C 5/02; A45C 13/10

[52] U.S. Cl. ..... 190/120; 190/28; 190/37; 190/100; 190/127

[58] Field of Search ..... 190/109, 37, 28, 100, 190/119–122, 12 A, 127; D3/76

[56] References Cited

U.S. PATENT DOCUMENTS

| | | | |
|---|---|---|---|
| D. 225,590 | 12/1972 | Valaguzza | D3/76 |
| D. 286,705 | 11/1986 | Miles | D3/76 X |
| D. 310,450 | 9/1990 | Castelli et al. | D3/76 |
| 1,667,014 | 4/1928 | Snell | 190/122 X |
| 1,767,143 | 6/1930 | La Duke | 190/28 |
| 1,827,542 | 10/1931 | Ritter, Jr. | 190/109 X |
| 1,984,934 | 12/1934 | La Duke | 190/28 |
| 2,415,220 | 2/1947 | Ritter | 190/119 X |
| 2,510,643 | 6/1950 | Long | 190/119 X |
| 2,604,961 | 7/1952 | Koch | 190/28 |
| 3,292,749 | 12/1966 | Reading | 190/119 |
| 3,592,314 | 7/1971 | Jacobson . | |
| 3,605,961 | 9/1971 | Marrion | 190/120 |
| 3,847,423 | 11/1974 | Gley | 292/113 |
| 3,891,070 | 6/1975 | Montanari | 190/117 |
| 3,967,708 | 7/1976 | Gregg et al. | 190/119 X |
| 4,094,392 | 6/1978 | Gregg et al. | 190/120 |
| 4,344,646 | 8/1982 | Michel | 292/87 |
| 4,509,622 | 4/1985 | Morszeck | 190/119 |

FOREIGN PATENT DOCUMENTS

| | | | |
|---|---|---|---|
| 2253024 | 7/1973 | Fed. Rep. of Germany | 190/115 |
| 1164440 | 10/1958 | France . | |
| 2455552 | 11/1980 | France . . | |
| 557535 | 2/1957 | Italy | 190/100 |
| WO86/01384 | 3/1986 | PCT Int'l Appl. | 190/18 A |
| 1089371 | 1/1967 | United Kingdom | 190/119 |
| 1271599 | 4/1972 | United Kingdom . | |
| 2031853 | 4/1980 | United Kingdom . | |
| 2064483 | 6/1981 | United Kingdom . | |

*Primary Examiner*—Sue A. Weaver
*Attorney, Agent, or Firm*—Gregory W. O'Connor

[57] ABSTRACT

A luggage case 11 comprises two shells 12 and 13 hinged together along their back wall 19. The case is fastened by three latches. One latch 26 is key operated and located at the middle of the front wall 18. The other two latches 24 and 25 are located at the front of the end walls of the case and prevent gaping of the case when it is overfilled. The latches 24 and 25 are secured by sliding bolts.

20 Claims, 8 Drawing Sheets

LUGGAGE CASE WITH RECESSED LATCHES

This is a continuation of copending application Ser. No. 07/319,843 filed on Mar. 7, 1989, now abandoned.

The present invention relates to a luggage case of the type that comprises two shells, each shell having a peripheral side wall, the side walls forming the front, back and end walls of the case, the two shells being hinged together at the back wall and having latches for releasably fastening the edges of the case together when the case is closed.

In the conventional luggage case two latches are provided on the front wall of the case. However with cases of this type which do not have a metal frame running all the way round the case, there is a tendency for the case to gape along the end edges when the case is overfilled or when a heavy load is placed in the centre of the lid of the case, for example when someone sits on the case. This is undesirable not only because small items of luggage may fall out of the case but also because it is impossible to provide an effective seal between the shells to keep out dirt and water.

On some known cases auxiliary latches are provided halfway along the end walls of the case to prevent gaping. However such latches are difficult to reach from the front of the case for fastening and unfastening particularly on large cases and therefore are inconvenient to use.

We have found that a surprising improvement in resistance to gaping over the known case with two latches on the front wall can be achieved if latches are located at the front of the end walls of the case or at the corners between the front and end walls of the case.

Thus according to the present invention there is provided a luggage case comprising two shells, each shell having a peripheral side wall, the side walls forming the front, back and end walls of the case, the two shells being hinged together at the back wall and having latches for releasably fastening the edges of the shells together when the case is closed, characterised in that two latches are located at the front of the end walls or at the corners between the front and end walls of the case.

By locating the latches in this position gaping of the end walls is avoided but the latches are easily accessible from the front of the case and therefore convenient to use.

The two latches may be the only latches on the case but preferably a third latch is provided on the front wall of the case for additional security and to avoid gaping of the front wall. For convenience the third latch may be the only latch provided with a key-operated or combination lock, the other two latches being secured by manually-operated bolts.

We have found that the invention is particularly effective in avoiding gaping if a reinforcing strip, for example of metal, is secured to one of the shells along the front wall. In the case where three latches are provided, the third latch may be fixed to the reinforcing strip. A carrying handle may also be fixed to the reinforcing strip. The reinforcing strip may extend along substantially the entire length of the front wall of the case, but terminate short of the said two latches.

A strip of elastomeric material may be provided along the edge of one of the shells so as to be clamped between the shells when the shells are closed to form a seal. By locating the latches where they will prevent gaping a seal around the entire edge of the case can be achieved. Preferably the seal is dust and water resistant so that when, for example, the case is placed on a roof rack on top of a car, water will not penetrate the case when the car is driven through rain.

Preferably the side wall of the shell that forms the base of the case is deeper along the back and end walls than along the front wall. In this way the contents of the case are less likely to fall out at the ends and back of the case when packing. The two shells may meet approximately along the centre-line of the front wall so that a carrying handle attached to the edge of the base shell may lie centrally on the front wall. The two latches may then be located in the region where the depth of the wall increases between the front and end walls.

The front portion of the end walls of the case preferably slope inwardly towards the front of the case and the latches are provided on these front portions. This arrangement makes the latches even more accessible from the front.

An embodiment of the invention will now be described by way of example with reference to the accompanying drawings of which:

Figure 1:
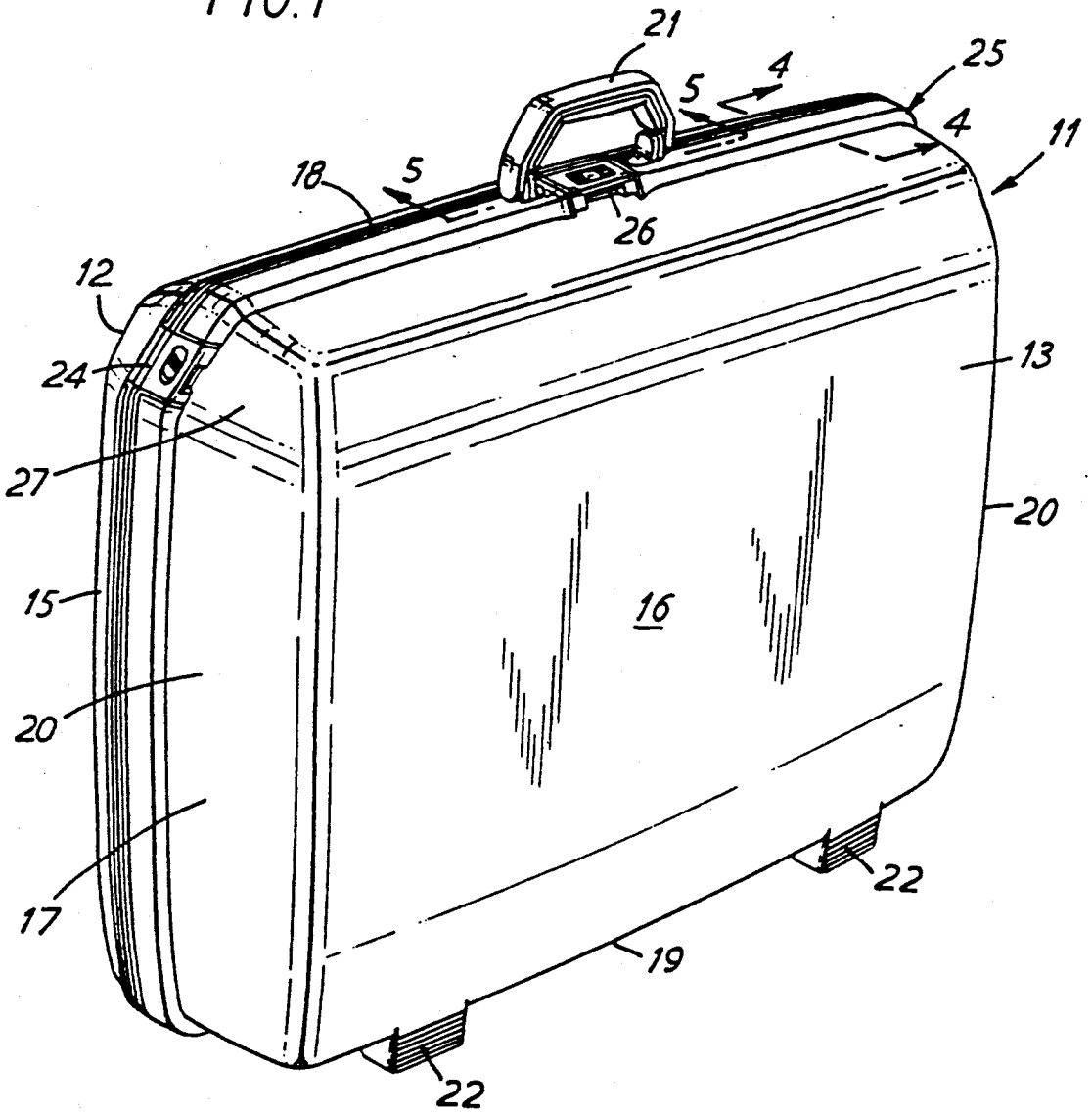
FIG. 1 shows a perspective view of a suitcase in accordance with the invention standing in an upright position on its back wall.

A suitcase 11 is formed as two shells 12 and 13 moulded from plastics material. One shell 12 constitutes the lid and comprises a top wall 14 and a peripheral side wall 15. The other shell constitutes the base and comprises a bottom wall 16 and a peripheral side wall 17. The side walls 15 and 17 together form the front wall 18, back wall 19 and end walls 20 of the suitcase.

A carrying handle 21 is mounted on the front wall of the base shell 13 and feet 22 are moulded on the back wall 19 of both shells for standing the suitcase in the upright position of FIG. 1.

Figure 11:
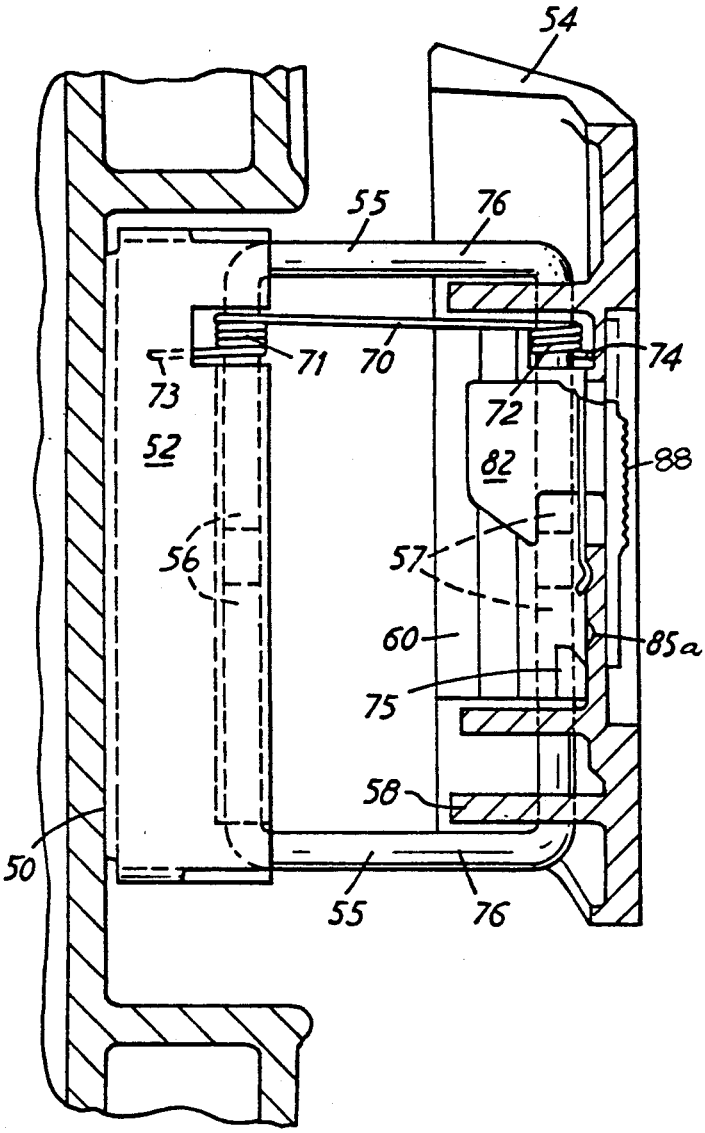
FIG. 11 shows a section on the line 11—11 of FIG. 6 with the latch in the open position.
Figure 12:
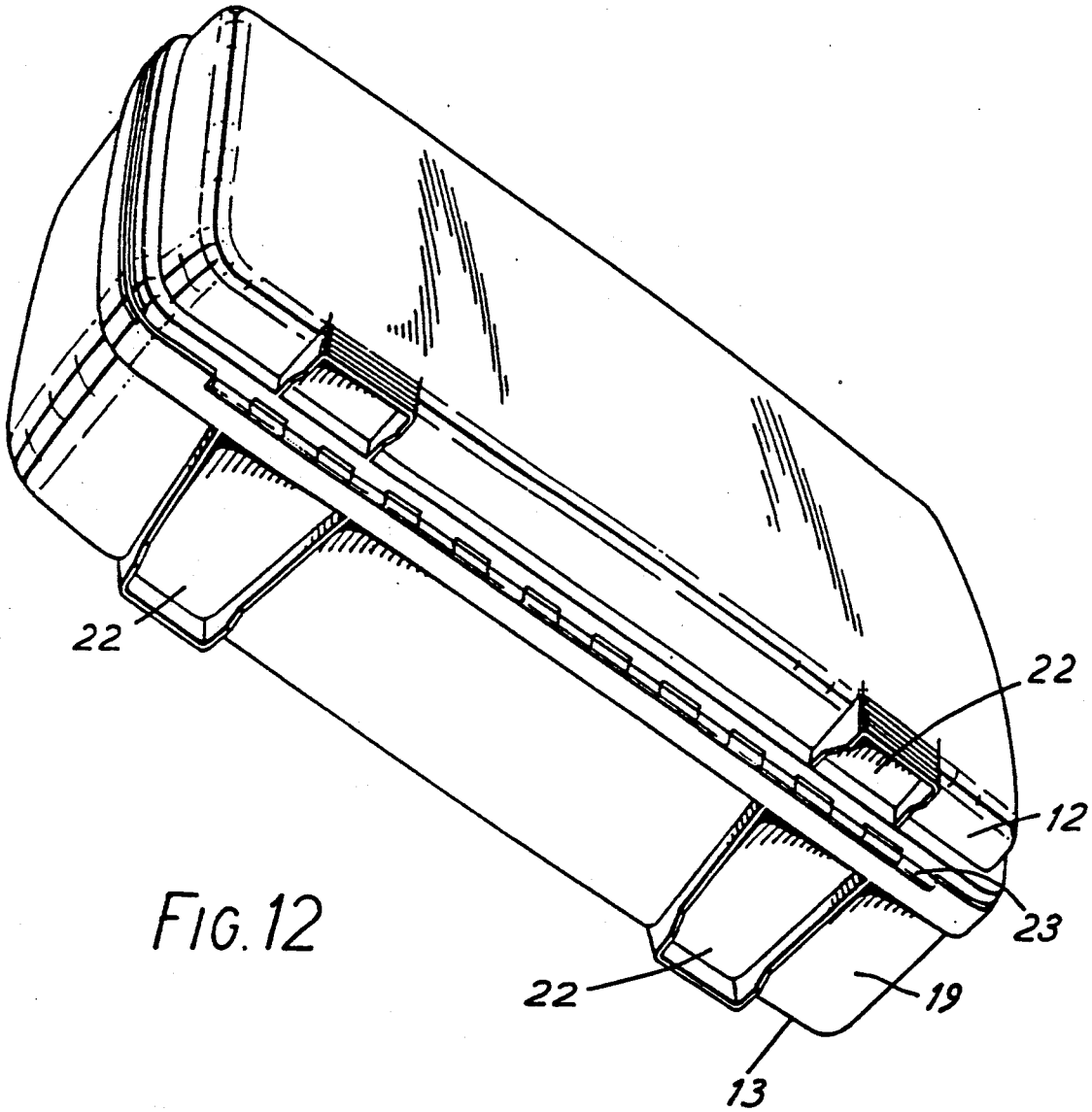
FIG. 12 shows a perspective view of the case of FIG. 1 from behind the back wall.

The two shells 12 and 13 are connected together by a hinge 23 (see FIG. 11) along the back wall so that the shells can be pivoted relative to one another between an open position in which the interior of the case is accessible and a closed position in which the contents of the case are enclosed within the shells. Three latches 24, 25 and 26 are provided for securing the edges of the case together when the case is closed.

Figure 2:
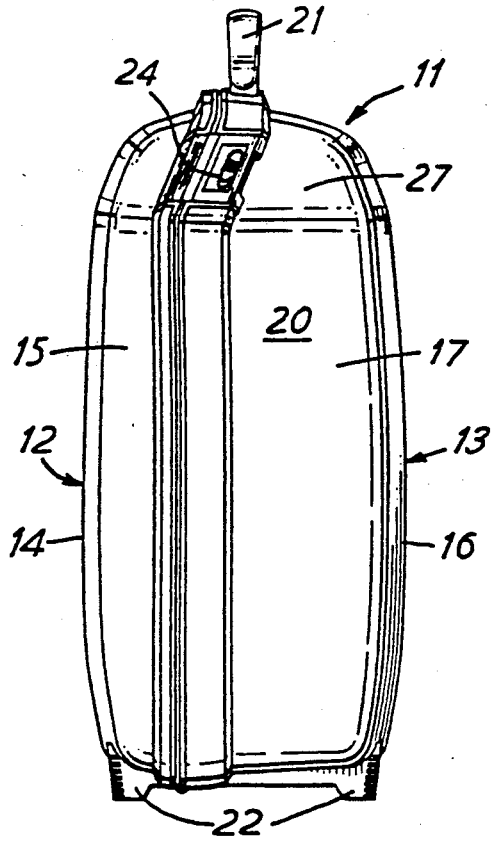
FIG. 2 shows an end elevation of the suitcase of FIG. 1.

As can be seen from FIGS. 1 and 2 the side wall of the base shell 13 is deeper at the back and end walls than at the front. At the front the side wall of the base shell 13 extends to just over half the overall height of the case whereas at the end walls and back wall the height of the side wall is about three quarters the overall height of the case. The greater height at the ends and back prevents the contents of the case spilling out when the case is opened whereas the lower front of the side wall of the base means that the carrying handle 21 can be fixed at the edge of the base shell 13 and yet lie on the centre-line of the front wall of the case.

Figure 3:
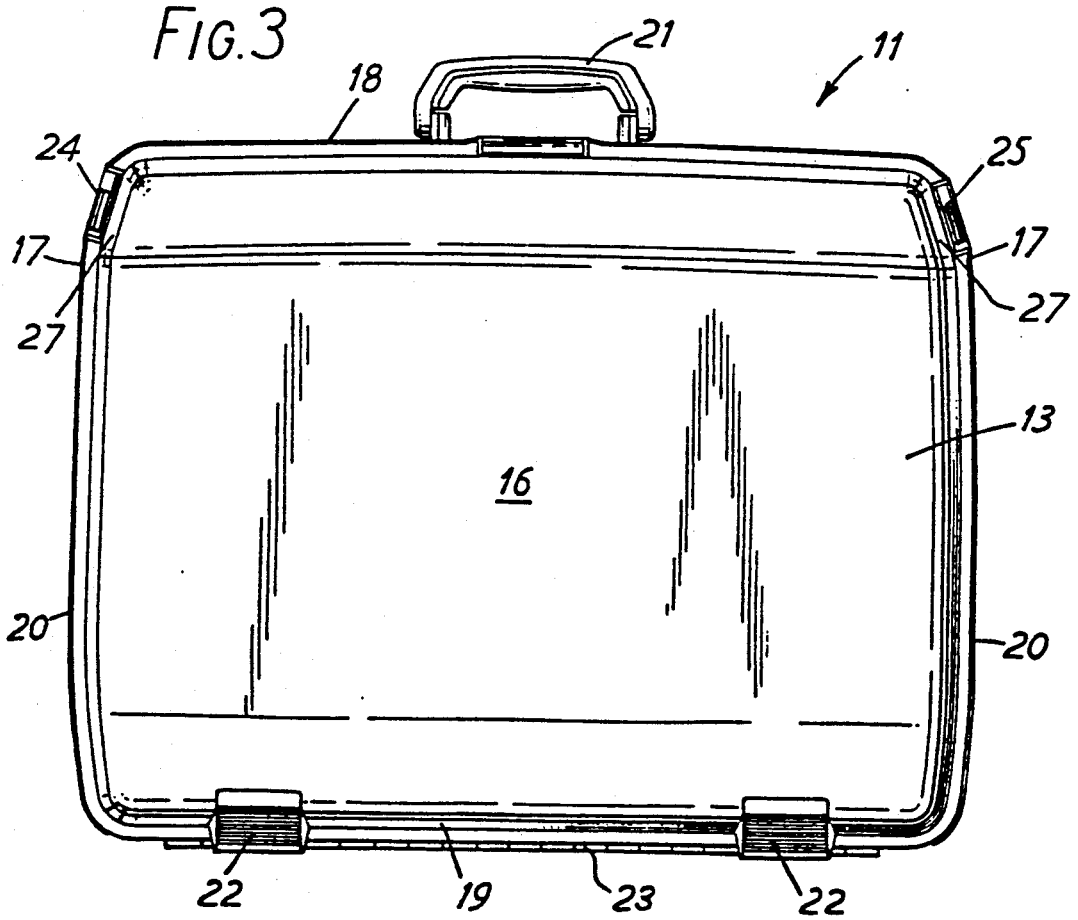
FIG. 3 shows an underneath plan view of the suitcase of FIG. 1.

As can be seen in FIG. 3 front portions 27 of the end walls of the case slope inwardly toward the front of the case. Two of the latches 24 and 25 are mounted on this front portion 27. The other latch 26 is mounted halfway along the front wall of the case. As can be seen most clearly in FIG. 2, it is also substantially only in the region of the front portion 27 that the depth of the side walls of the base shell increases from the front wall to the end walls.

Figure 4:
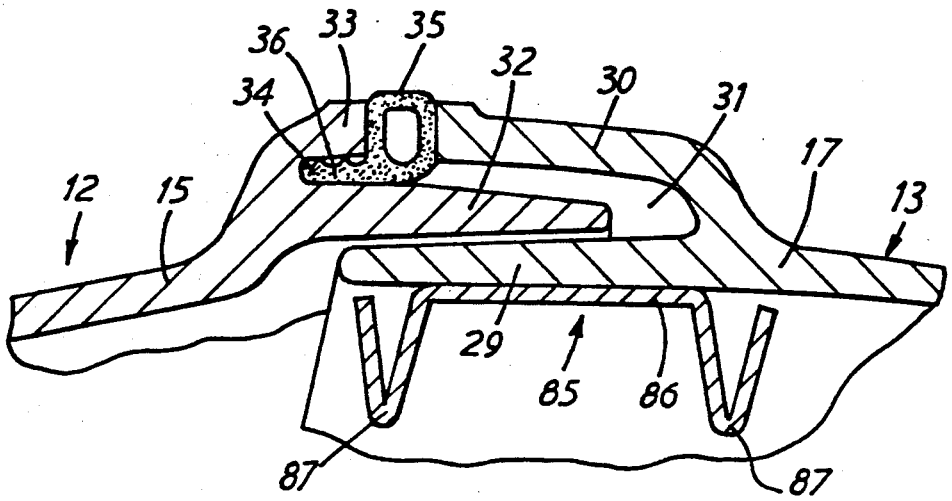
FIG. 4 shows a section on the line 4—4 of FIG. 1 on an enlarged scale.

FIG. 4 shows the construction of the edges of the shells 12 and 13. At its edge the base shell 13 is formed with an inner lip 29 and an outer lip 30 with an open channel 31 between them. The inner and outer lips are joined at the bottom of the channel 31 to the peripheral side wall of the base shell. The inner lip 29 projects beyond the outer lip 30. Similarly the lid shell 12 is formed at its edge with an inner lip 32 and an outer lip 33 with a channel 34 between, the inner and outer lips being joined together at bottom of the channel 34 to the rest of the peripheral side wall 15. The inner lip 32 projects beyond the outer lip 34 by a distance greater than the projection of the lip 29 beyond the wall 30. The edges of the shells are configured so that the inner lip 32 of the lid shell 12 is aligned with and fits into the channel 31 in the edge of the base shell and the outer lips 33 and 30 are aligned with each other.

A hollow tubular sealing strip 35 of rubber or other elastomeric material has an integral longitudinal mounting flange 36 projecting along its entire length. The mounting flange is a force fit in the channel 34 and the hollow tubular portion of the sealing strip sits on the edge of the outer lip 33 of the lid shell 12.

When the case is closed the inner lip of the lid shell 12 enters the channel 31 between the inner and outer lips that form the edge of the base shell. The hollow tubular portion of the sealing strip 35 is squashed between the edges of the outer lips 33 and 30 of the lid shell and base shell to form a seal against the ingress of dirt and water to the case.

It will be noted that the sealing strip 35 is visible when the case is closed. The strip may be coloured to contrast with the colours of the shell to give the case a pleasing aesthetic appearance. The strip is designed to be of greater thickness than the gap between the lips 30 and 33 so that is compressed when the case is closed. With this arrangement the sealing strip will take up variations in the spacing of the lips 30 and 33 due to manufacturing tolerances. For example, the strip may be 2 mm thicker than the gap between the outer lips 30 and 33 of the base and lid shells.

As can be seen in FIG. 4, a metal strip 85 is secured to the inside of the base shell 13 along the edge of the front wall. The strip extends substantially along the whole length of the front wall of the case but terminates at the corners. The latches 24 and 25 in this embodiment are not fastened to the strip 85 but are spaced a short distance away from the ends of the strip. The strip has a flat central web portion 86 with two V-shaped ribs 87 running its edges to provide stiffness. The strip is mounted with its flat web portion against the inner surface of the inner lip 29. The strip 85 serves to stiffen the front edge of the case to prevent gaping. It also reinforces the case in the region where the central latch 26 and the carrying handle 21 are attached. The strip distributes the load on the shell of the case along the length of the front wall when the case is being carried.

Figure 5:
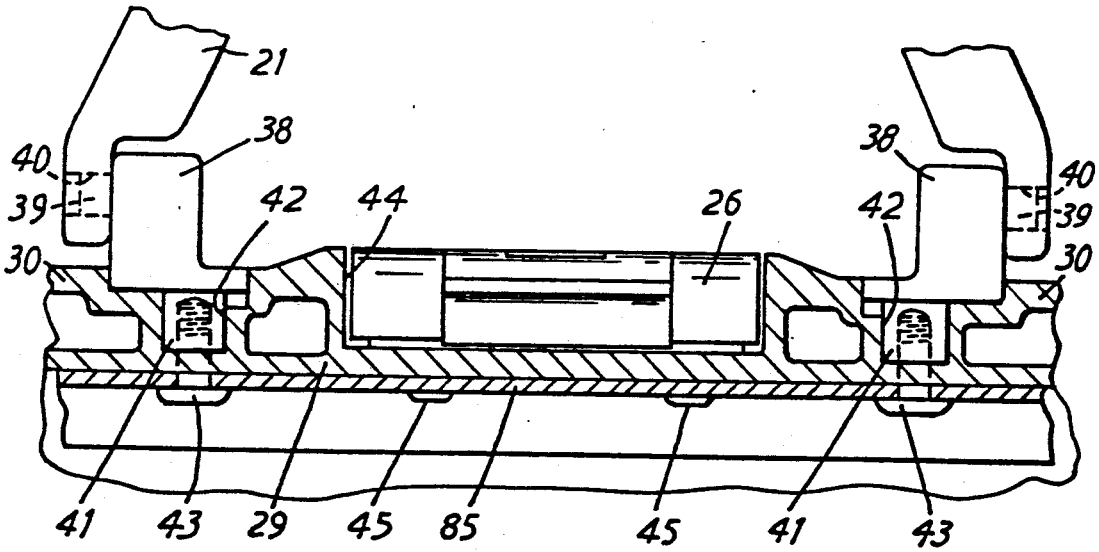
FIG. 5 shows a section on the line 5—5 of FIG. 1 on an enlarged scale.

FIG. 5 shows how the carrying handle 21 is secured to the case. Two mounting brackets 38 carry cylindrical stub shafts 39 which fit into holes 40 in the ends of the handle 21 so that the handle can pivot about the stub shafts 39. The handle 21 may be formed of soft pliable plastics material moulded over a metal core, the stub shafts 39 fitting into holes in the ends of the metal core. A cylindrical projection 41 on the underside of each mounting bracket 38 fits into a hole 42 moulded into the outer lip 30 of the base shell 13. Self tapping screws 43 pass from inside the case through holes in the metal strip 35, through holes in the inner wall 29 of the base shell and into bores in cylindrical projections 41 of the mounting brackets, this securing the handle to the outside of the base shell and the metal strip to the inside of the base shell.

The central latch 26 is located in a gap 44 in the outer lip 30 and secured to the base shell by self tapping screws 45 passing through the metal strip 35 and the inner wall 29 of the base shell 13.

The latch 24 is shown in detail in FIGS. 6 to 11.

A metal mounting plate 50 is secured to the inner wall 29 of the base shell by self tapping screws 51, there being a gap in the outer wall 30 to accommodate the latch 24. One edge of the plate 50 is bent up to form an upstanding portion 52 and curved over at the top to provide a bearing sleeve 53. A latch member 54 is coupled to the mounting plate by two U-shaped links 55, one leg 56 of each link being inserted into the bearing sleeve 53 the other leg 57 being inserted through holes in webs 58 on the underside of the member 54. Thus the U-shaped links 55 can pivot about the axis of the bearing sleeve 43 and the latch member 54 can pivot on the links 55 about the axis of the holes in the webs 58. Two stops 59 bent from the upstanding portion 52 of the mounting plate 50 prevent the U-shaped links 55 falling out after thay have been inserted.

A catch 60 is pivotally mounted on those limbs 57 of the U-shaped links 55 that pass through the webs 58 on the latch member 54. The edge of the mounting plate 50 opposite the upstanding portion 52 is bent upwards and then outwards to form a lip 61 spaced above the base plane of the mounting bracket 50. When the latch 24 is closed a hook-like portion 62 of the catch 60 engages under the lip 61 to hold the latch closed.

A spring 70 is coiled first at 71 around the limb 56 of one of the U-shaped links 55, and then, at 72, around the limb 57 of the same link. One end 73 of the spring bears against the upstanding portion 52 of the mounting bracket 50, the other end 74 bears against the catch 60 so that the links 55 are biased to turn in a clockwise direction about the bearing sleeve 53 as viewed in FIGS. 8 and 9 and the catch 60 is biased to turn in an anti-clockwise direction about the limb 57 of the U-shaped link.

The catch 60 has a projection 75 which engages the underside of the latch member 54. As the catch 60 is biased in an anti-clockwise direction so the projection 75 causes the latch member 54 to be biased in an anti-clockwise direction about the limb 57 of the link 55. Movement of the latch member 54 in an anti-clockwise direction relative to the link 55 is limited by the base portions 76 of the links engaging a stop surface 77 on the underside of the plate. Movement of the link 55 about the bearing sleeve 53 is limited by the base portions 76 of the links 55 engaging a part 78 of the upstanding portion 52 of the mounting bracket. Thus when released the latch 24 will assume the position shown in FIGS. 7 and 9.

For securing the latch in the closed position a bolt 80 is provided. The elongate D-ended bolt 80 is a sliding fit in a longer elongate D-ended recess 81 in the upper surface of the latch member 54. A hook 82 projecting from the underside of the bolt passes through a hole 83 in the floor of the recess 81. A spring clip 84 engages in slots in the sides of the hook and serves to retain the bolt 80 in the recess 81. The clip 84 has a rib 85*a* on one end which is engagable in a respective one of two recesses 86*a* and 87*a* in the underside of the plate 54 at either end of the sliding travel of the bolt 80 so as to locate the bolt and prevent it being moved accidentally. A raised ridged portion 88 is formed on the upper side of the latch to form a grip.

A bracket 90 is struck out of the mounting plate 50. When the latch is in the closed position the bolt 80 can be slid to the position shown in FIGS. 6 and 10. The hook 82 on the bolt engages beneath the bracket 90 preventing the latch being released even when the catch 60 is released. The rib 85*a* on the spring clip 84 engages the recess 87*a* to prevent the bolt accidentally moving from the locked position. The bolt can however be moved by pushing the bolt manually on the gripping ridge portion 88 to move the bolt into the unlocked position shown in FIG. 7. In this position the hook 82 is removed from beneath the bracket 90 so that the latch can be released when the catch 60 is released. The rib 85*a* on the spring clip engages the recess 86*a* to hold the bolt in the unlocked position.

The latch member 54 has a hook-like portion 91 extending along the whole length of the edge remote from the U-shaped links. In the region of the latch 24 the base shell 13 has no outer lip 30 but an upright projection 92 extends from the inner lip to provide the surface against which the sealing strip 35 on the lid shell 12 is pressed when the case is closed. In the region of the latch the inner lip 32 of the lid shell 12 is cut back so that it does not project beyond the sealing strip 35 since in this region there is no channel 31 in the edge of the base shell for receiving the inner lip of the lid. Behind the edge moulding of the lid a recess 93 is formed for receiving the hook portion 91 of the latch.

To fasten the latch 24 starting from the position shown in FIG. 6 one proceeds as follows. The two shells 12 and 13 of the case are brought together and the latch member 54 is rotated in a clockwise direction against the action of the spring 70 to engage the hook portion 91 in the recess 93. The end of the latch member adjacent the links 55 is then pressed towards the case, the links 55 pivoting in an anti-clockwise direction against the action of the spring and the latch member 54 pulling the two shells tightly together as the links 55 rotate with a toggle action. As the latch member 54 approached the mounting bracket 50 as bevelled leading edge 94 of the hook portion of the catch 60 engages the lip 61 causing the catch 60 to rotate in a clockwise direction about the axis of the limbs 57 against the action of the spring 70 so that the hook portion 62 can pass the lip 61. Once the hook portion 61 is past the lip 61 the action of the spring 70 causes the catch 60 to return in the anti-clockwise direction for the hook portion 62 to engage below the lip 61 thus holding the latch in the closed position.

If the bolt 80 is in the locked position at the beginning of this operation, that is with the rib 85*a* in the recess 86*a*, the bracket 90 will engage an inclined leading surface 95 on the hook portion 82 of the bolt forcing the bolt to move into the unlocked position.

Figure 6:
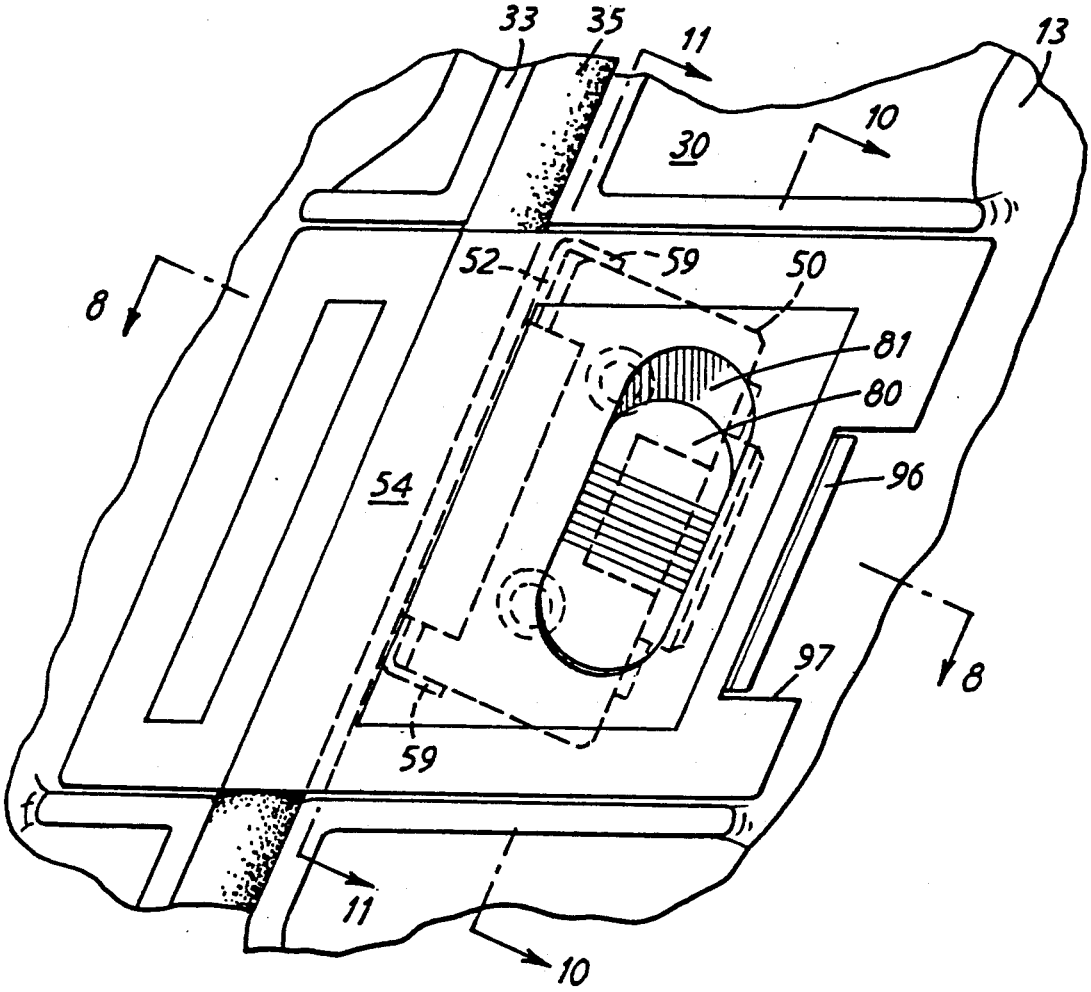
FIG. 6 shows a fragmentary end view of the suitcase of FIG. 1 on an enlarged scale showing a latch.
Figure 7:
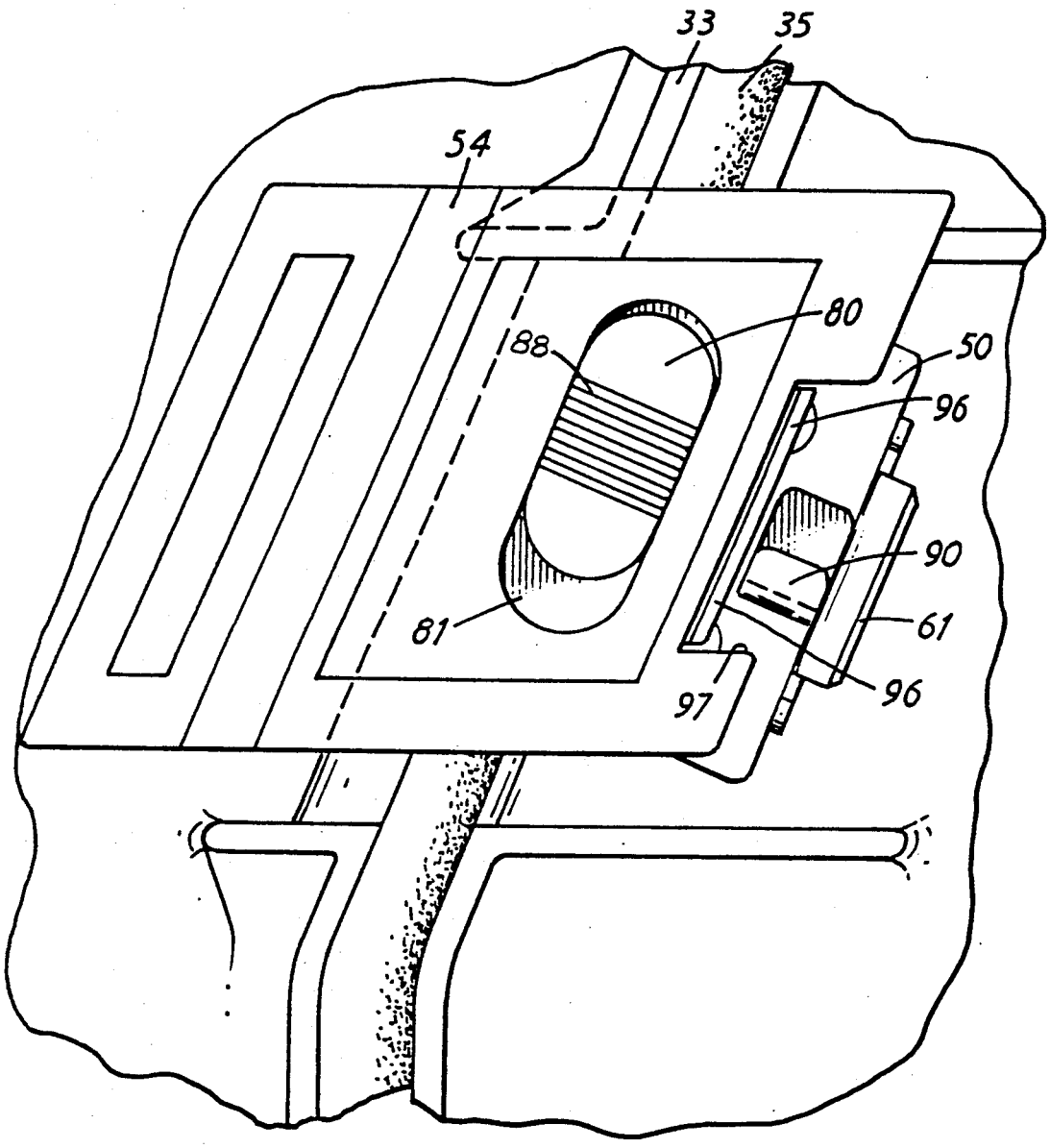
FIG. 7 shows a view similar to FIG. 6 but with the latch in the open position.
Figure 8:
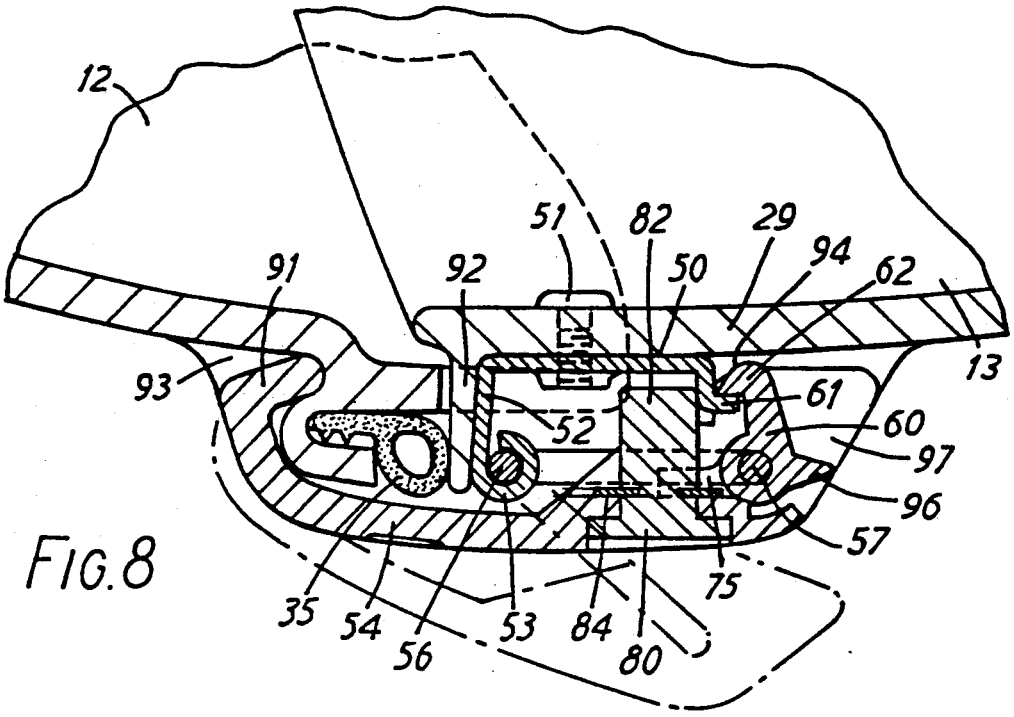
FIG. 8 shows a section on the line 8—8 of FIG. 6.
Figure 9:
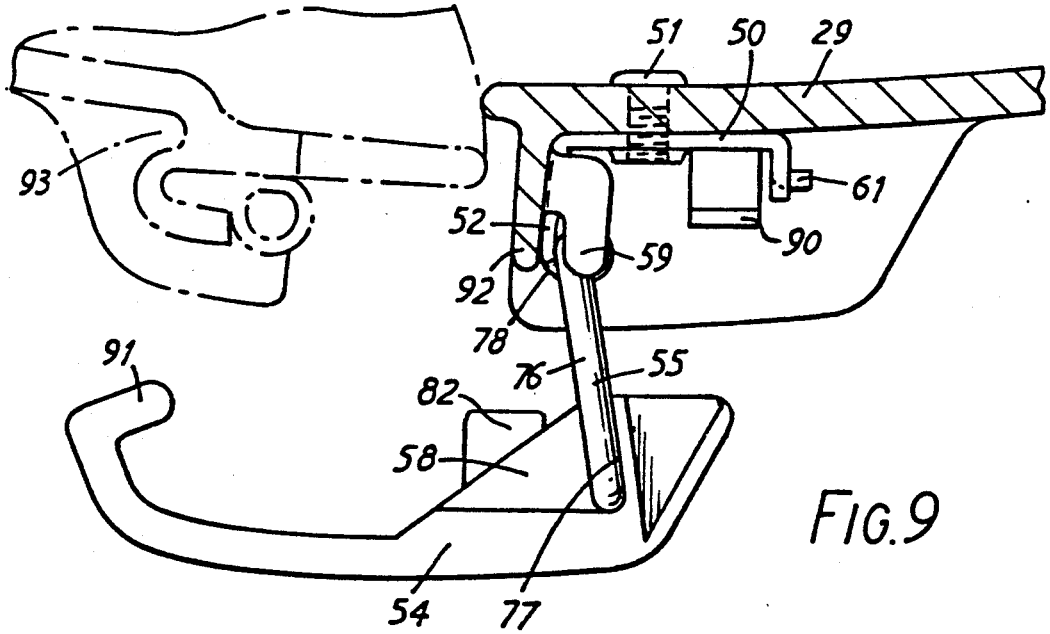
FIG. 9 shows a section on the line 8—8 of FIG. 6 with the latch in the open position.
Figure 10:
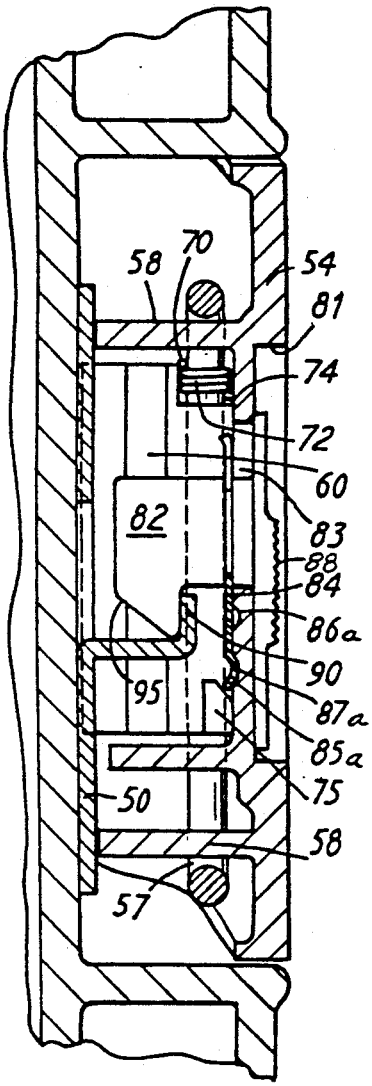
FIG. 10 shows a section on the line 10—10 of FIG. 6.

Once the latch 24 is closed it may be secured by sliding the bolt 80 into the locked position shown in FIGS. 6 and 10.

To release the latch the bolt 80 is first slid to the unlocked position. Then the catch 60 is rotated in the clockwise direction against the action of the spring 70. For this purpose a rib 96 is provided on the catch 60. The rib extends axially along the length of the catch and projects into a cut-out portion 97 in the edge of the latch member 54. Squeezing the rib 96 towards the main body of the latch member 54 causes the catch to rotate clockwise releasing the hook portion 62 from under the lip 61 so that the latch member can pivot away from the case into the position shown in broken line in FIG. 8. From this position the hook portion 91 of the latch member can be released from ther recess 93.

It will be noted that the latch member 54 has an asymmetrical shape. This shape permits the mounting bracket 50 and hook portion 91 to be aligned with the sloping edge of the case shells in the region when the depth of the side wall of the base shell increases from the front to the end walls whilst ensuring that the side edges of the latch member 54 are vertical relative to the bottom wall of the case.

The latch 25 is a mirror image of the latch 24 but identical in all other respects. The central latch 26 is constructed in a similar manner except that instead of a sliding bolt 80, the central latch 26 has a rotary key-operated catch for engaging under a bracket corresponding to the bracket 90 to lock the latch in the closed position.

The latches 24 and 25 prevent gaping of the edges of the shells at the ends of the case when the case is overfilled or when a large load is placed on the case. These latches are however easy to reach from the front of the case. By providing sliding bolts rather than key operated locks to secure the latches 24 and 25 in the closed position, and only a key operated lock on the central latch 26, the case takes no longer to open than a case with two key operated locks in the conventional position.

The sealing strip 35 extends around the whole periphery of the case. It is not interrupted in the region of the latches. When fastened, the latches extend across and to the outside of the sealing strip 35. Thus, when the case is closed and fastened, the strip 35 forms a continuous seal around the case.

We claim:

1. A luggage case comprising two shells, one constituting a base shell and the other a lid shell, said luggage case having a case back wall and a case front wall opposite said case back wall and case end walls extending between said case front wall and case back wall, said shells being hinged together at the case back wall, each of said shells having a peripheral side wall which engages the peripheral side wall of the other of said shells at the edges of said peripheral side walls when the case is closed, the shells being constructed such that if latched closed only along the case front wall, the edges have a tendency to gap open at the case end walls when the case is overfilled or when someone sits on the case, and latch means releasably fastening said edges together when the case is closed, the peripheral side wall of said base shell including a front wall, a back wall and end walls, said front wall of said base shell including a handle means for carrying said case, said latch means including latches positioned on front portions of the case end walls at the corners between the case front wall and the case end walls, the peripheral side wall of said base shell is deeper along the back and end walls than along the front wall, the depth of the peripheral wall of said base shell increasing from the front wall to the end walls substantially only in said front portions, whereby resistance to said tendency to gap open is improved.

2. A luggage case according to claim 1 characterized in that said front portions of the end walls of the case slope inwardly toward the front wall of the case.

3. A luggage case according to claim 2 characterized in that a third latch is provided on the front wall of the case.

4. A luggage case according to claim 1 characterised in that a third latch is provided on the front wall of the case.

5. A luggage case according to claim 4 characterised in that the third latch is secured by a key or combination lock, and the first two latches are secured by manually-operated bolts.

6. A luggage case according to claim 1, 2, 4 or 5 characterized in that a reinforcing strip is secured to one of the shells extending along substantially only the case front wall.

7. A luggage case according to claim 1, 2, 4 or 5 characterised in that an elastomeric strip is provided along the edge of one of the shells, the strip being clamped between the two shells when the case is closed to form a seal.

8. A luggage case according to claim 7 characterised in that said elastomeric strip extends around the entire periphery of the case.

9. A luggage case according to claim 8 characterised in that the latches extend across and to the outside of the said elastomeric strip when the latches are closed.

10. A luggage case according to claim 6 characterized in that an elastomeric strip is provided along the edge of one of the shells, the strip being clamped between the two shells when the case is closed to form a seal.

11. A luggage case comprising two shells, one constituting a base shell and the other a lid shell, said luggage case having a case back wall and a case front wall opposite said case back wall and case end walls extending between said case front wall and case back wall, said shells being hinged together at the case back wall, each of said shells having a peripheral side wall which engages the peripheral side wall of the other of said shells at the edges of said peripheral side walls when the case is closed, the shells being constructed such that if latched closed only along the case front wall, the edges have a tendency to gap open at the case end walls when the case is overfilled or when someone sits on the case, and latch means releasably fastening said edges together when the case is closed, the periperal side wall of said base shell including a front wall, a back wall and end walls, said front wall of said base shell including a handle means for carrying said case, said latch means including latches positioned on front portions of the case end walls at the corners between the case front wall and the case end walls, the peripheral side wall of said base shell is deeper along the back and end walls than along the front wall, the depth of the peripheral wall of said base shell increasing from the front wall to the end walls substantially only in said front portions, the luggage case further including a strip for stiffening said case fastened against the front wall of the base shell, said strip extending across the length of the front wall but terminating at said corners, whereby resistance to said tendency to gap open is improved.

12. A luggage case (11) comprising two sheels (12, 13) each shell having a peripheral side wall (15, 16), the side walls forming a front (18), back (19), and end walls (20) of the case, the two shells having at least two latches (24, 25) for releasably fastening the edges of the shells together when the case (11) is closed, the latches (24, 25) being located near the corners between the front (18) and end walls (20) of the case, the periphery of at least a first of the shells (12,13) being formed with an outwardly projecting lip (33, 30) projecting above the surface of the shell, said outwardly projecting lip has a surface contour and includes at least two spaces formed therein, each space sized to receive a portion of one of said latches, each of said latches (24, 25) is positioned on the outside of one of the shells in the region of a corresponding one of said spaces, each said latch (24, 25) includes a latch member (54) with a hooked portion (91) and an outer surface having a contour which is substantially similar to said surface contour of said lip, said first one of said shells (12,13) including two external recesses (93) each positioned in a corresponding one of said spaces and sized to receive the hooked portion (91) of the corresponding latch member (54), whereby when the case is closed the hooked portion (91) of one of the latch members engages into the corresponding recess (93) in the other of the shells, and when the latch is so fastened at least the hooked portion of one of the latch members fits within a corresponding one of said spaces and said outer surface of the latch member is substantially flush with the surface contour of said lip (33, 30).

13. A luggage case according to claim 12, characterized in that a third latch (26) is provided on the front wall (18) of the case, at a space in the lip (30, 33) of the shell carrying the aforementioned two latches (24, 25), said space located on the front wall of the case, the third latch (26) having a latch member, a portion of which fits within said last mentioned space.

14. A luggage case according to claim 13, characterized in that the third latch (26) is secured by a key or combination lock, and the first two latches (24, 25) are secured by manually operable catches (60).

15. A luggage case according to claim 12, characterized in that a substantially continuous elastomeric strip (35) is provided along the edge of one of the shells (12) and projects towards the other end of said shells, and in use, when the case is closed, the elastomeric strip (35) is clamped between the shells (12, 13) by the clamping action of the latches to form a seal, the latches engaging across and to the outside of the sealing strip (35).

16. A luggage case according to any claim 15, characterized in that a reinforcing strip (86) is secured to one of the shells (13) along the front wall (18).

17. A luggage case according to claim 15, characterized in that the elastomeric strip comprises a tubular portion and a longitudinal mounting flange (36) projecting from the tubular portion along its length, and in that the edge of the shell (12) carrying the elastomeric strip is formed with an inner lip (32) and an outer lip (33) with an open channel (34) therebetween sized to tightly engage the flange (36) of the elastomeric strip (35) to secure the strip to the shell.

18. A luggage case according to claim 17, characterized in that the inner lip (32) of the shell (12) carrying the elastomeric strip (35) extends beyond the outer lip (33) to form an edge projecting toward the other one of said shells (32), the edge of the other shell (13) is formed with an inner lip (29) and an outer lip (30) with an open channel (31) therebetween sized to receive the projecting edge of said inner lip (32) of said shell carrying the elastomeric strip whereby, in use, when the case is closed, the inner lip (32) of the shell (12) carrying the elastomeric strip (35) enters the channel (31) between the inner (29) and outer (30) lips of the other one of said shells (13), with the tubular portion of the strip (35) being clamped between the outer lips (30, 33) of the shells.

19. A luggage case according to claim 18, characterized in that the latches (24, 25, 26) are mounted on one of the shells (13), and the elastomeric strip (35) is mounted on the other (12) of the shells.

20. A luggage case according to claim 18, characterized in that in the region of the latches there is no outer lip (30) on the shell carrying the latches (24, 25, 26), an upright projection (92) instead extending from the inner lip (29) in the regions of the latches to provide a surface to clamp the elastomeric strip (35).

* * * * *